US006650995B2

(12) United States Patent
Bullock

(10) Patent No.: US 6,650,995 B2
(45) **Date of Patent: *Nov. 18, 2003**

(54) METHOD OF OPTIMIZING TRAFFIC CONTENT

(75) Inventor: James Blake Bullock, Gilbert, AZ (US)

(73) Assignee: Motorola, Inc., Schaumburg, IL (US)

( * ) Notice: Subject to any disclaimer, the term of this patent is extended or adjusted under 35 U.S.C. 154(b) by 172 days.

This patent is subject to a terminal disclaimer.

(21) Appl. No.: 10/098,123

(22) Filed: Mar. 13, 2002

(65) Prior Publication Data

US 2002/0120390 A1 Aug. 29, 2002

Related U.S. Application Data

(63) Continuation of application No. 09/791,452, filed on Feb. 26, 2001, now Pat. No. 6,463,382.

(51) Int. Cl.[7] ..... G06G 7/76

(52) U.S. Cl. ..... 701/117; 701/24; 701/200

(58) Field of Search ..... 701/117, 118, 701/119, 200, 213, 23, 24; 342/357.06, 357.09, 357.1

(56) References Cited

U.S. PATENT DOCUMENTS 5,610,821 A 3/1997 Gazis et al.

FOREIGN PATENT DOCUMENTS

| | | | |
|---|---|---|---|
| DE | 19611915 | A1 | 10/1997 |
| DE | 19651143 | A1 | 6/1998 |
| WO | WO01/01077 | A1 | 1/2001 |

*Primary Examiner*—Yonel Beaulieu
(74) *Attorney, Agent, or Firm*—Kevin D. Wills

(57) ABSTRACT

A method of optimizing traffic content includes providing a traffic flow algorithm (220) coupled to receive a set of solicited navigation route data (210) and a set of solicited traffic data (212) between a starting location (305, 405) and a destination location (310, 410), where traffic flow algorithm (220) is designed to compute a set of optimized traffic content (230) between a starting location (305, 405) and a destination location (310, 410). A set of unsolicited user-defined navigation route data (215) is received and incorporated into traffic flow algorithm (220).

22 Claims, 5 Drawing Sheets

400

METHOD OF OPTIMIZING TRAFFIC CONTENT

This application is a continuation of U.S. patent application Ser. No. 09/791,452 filed on Feb. 26, 2001, now U.S. Pat No. 6,463,382.

FIELD OF THE INVENTION

This invention relates generally to traffic content in a distributed communications system and, in particular to a method of optimizing traffic content in a distributed communications system.

BACKGROUND OF THE INVENTION

Vehicle drivers seek to find the optimum routes from their origin point to their destination point so they can minimize travel time and fuel consumption. Current methods for finding optimum routes are based on static digital road map databases and limited real-time traffic monitoring equipment. Typically, the road map data computes optimal routes based on estimated travel times from the road classification and/or speed limit data. This method has the disadvantage in that the data may not reflect the actual travel times because of stop signs, normal traffic patterns, weather and road conditions, accidents, construction, and the like. Real-time traffic monitoring equipment is currently available only on some major freeways and arteries. This leaves potential routes out of reach of real-time traffic monitoring and hence unavailable for incorporation into a route optimization scheme.

Optimum routes are generally computed based on weighting strategies for road segments and intersections. The real-time traffic information is treated as a dynamic weight for the individual road segments affected and routes can be computed taking the traffic into consideration where available. However, these methods are based on static data and limited real-time information. This has the disadvantage of improper weighting of road segments due to a lack of real-time traffic data for any given time of the day or week, which in turn creates sub-optimal routing schemes.

Accordingly, there is a significant need for methods of route optimization and traffic information acquisition that overcome the deficiencies of the prior art outlined above.

BRIEF DESCRIPTION OF THE DRAWINGS

Referring to the drawing.

Figure 1:
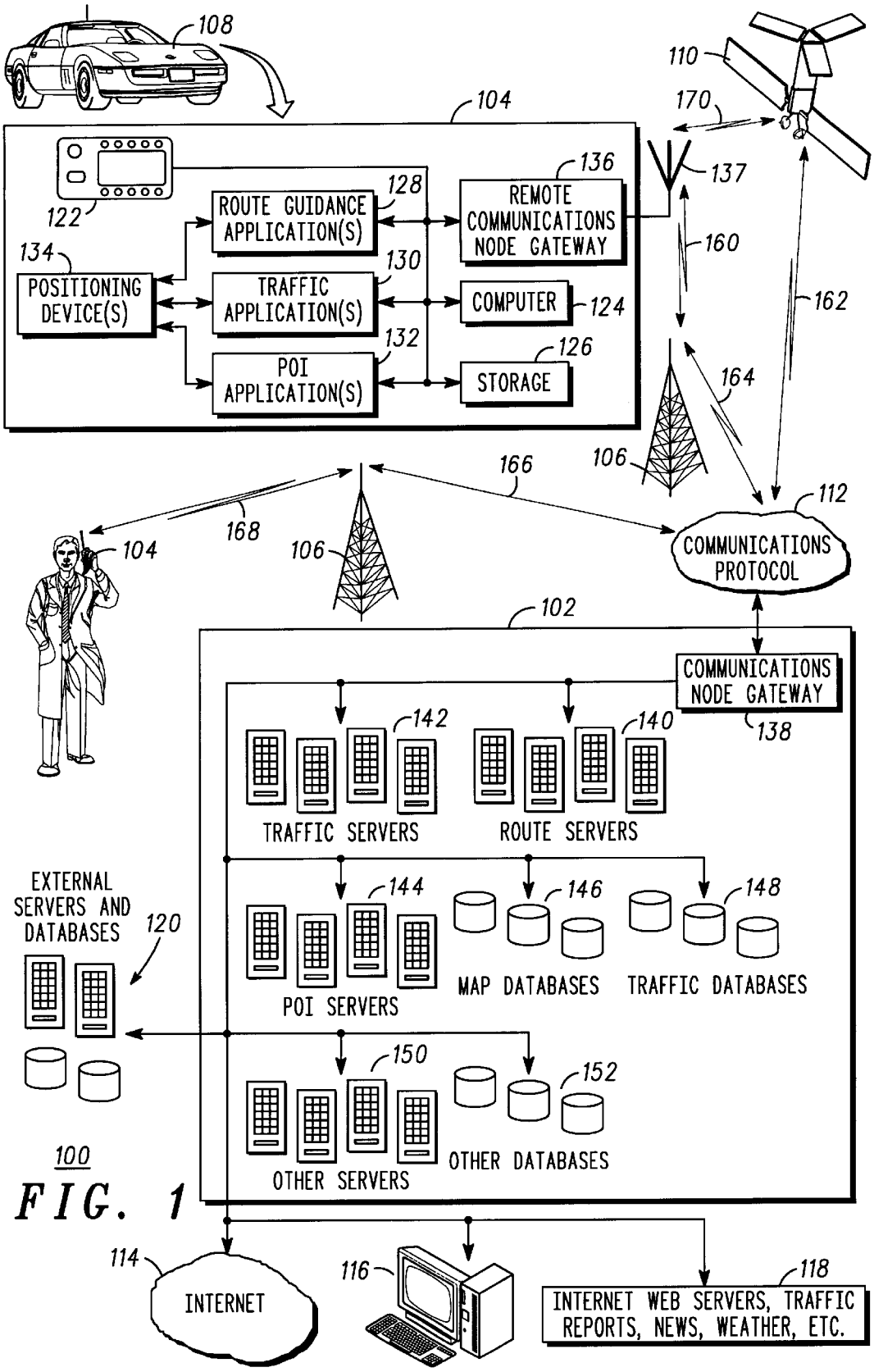
FIG. 1 depicts an exemplary distributed communications system, according to one embodiment of the invention.

It will be appreciated that for simplicity and clarity of illustration, elements shown in the drawing have not necessarily been drawn to scale. For example, the dimensions of some of the elements are exaggerated relative to each other. Further, where considered appropriate, reference numerals have been repeated among the Figures to indicate corresponding elements.

DESCRIPTION OF THE PREFERRED EMBODIMENTS

The present invention is a method of optimizing traffic content with software components running on mobile client platforms and on remote server platforms. To provide an example of one context in which the present invention may be used, an example of a method of optimizing traffic content will now be described. The present invention is not limited to implementation by any particular set of elements, and the description herein is merely representational of one embodiment. The specifics of one or more embodiments of the invention are provided below in sufficient detail to enable one of ordinary skill in the art to understand and practice the present invention.

FIG. 1 depicts an exemplary distributed communications system 100 according to one embodiment of the invention. Shown in FIG. 1 are examples of components of a distributed communications system 100, which comprises among other things, a communications node 102 coupled to a remote communications node 104. The communications node 102 and remote communications node 104 can be coupled via a communications protocol 112 that can include standard cellular network protocols such as GSM, TDMA, CDMA, and the like. Communications protocol 112 can also include standard TCP/IP communications equipment. The communications node 102 is designed to provide wireless access to remote communications node 104, to enhance regular video and audio broadcasts with extended video and audio content, and provide personalized broadcast, information and applications to the remote communications node 104.

Communications node 102 can also serve as an Internet Service Provider to remote communications node 104 through various forms of wireless transmission. In the embodiment shown in FIG. 1, communications protocol 112 is coupled to local nodes 106 by either wireline link 166 or wireless link 164. Communications protocol 112 is also capable of communication with satellite 110 via wireless link 162. Content is further communicated to remote communications node 104 from local nodes 106 via wireless link 160, 168 or from satellite 110 via wireless link 170. Wireless communication can take place using a cellular network, FM sub-carriers, satellite networks, and the like. The components of distributed communications system 100 shown in FIG. 1 are not limiting, and other configurations and components that form distributed communications system 100 are within the scope of the invention.

Remote communications node 104 without limitation can include a wireless unit such as a cellular or Personal Communication Service (PCS) telephone, a pager, a handheld computing device such as a personal digital assistant (PDA) or Web appliance, or any other type of communications and/or computing device. Without limitation, one or more remote communications nodes 104 can be contained within, and optionally form an integral part of a vehicle 108, such as a car, truck, bus, train, aircraft, or boat, or any type of structure, such as a house, office, school, commercial establishment, and the like. As indicated above, a remote communications node 104 can also be implemented in a device that can be carried by the user of the distributed communications system 100.

Communications node 102 can also be coupled to other communications nodes (not shown for clarity), the Internet 114, Internet web servers 118 and external severs and databases 120. Users of distributed communications system 100 can create user-profiles and configure/personalize their user-profile, enter data, and the like through a user configuration device 116, such as a computer. Other user configuration devices 116 are within the scope of the invention and can include a telephone, pager, PDA, Web appliance, and the like. User-profiles and other configuration data is preferably sent to communications node 102 through a user configuration device 116, such as a computer with an Internet connection 114 using a web browser as shown in FIG. 1. For example, a user can log onto the Internet 114 in a manner generally known in the art and then access a configuration web page of the communications node 102. Once the user has configured the web page selections as desired, he/she can submit the changes. The new configuration, data, preferences, and the like, including an updated user-profile, can then be transmitted to remote communications node 104 from communications node 102.

As shown in FIG. 1, communications node 102 can comprise a communications node gateway 138 coupled to various servers and software blocks, such as, traffic servers 142, route servers 140, and point-of-interest (POI) servers 144, and the like. The various servers depicted in FIG. 1 can comprise a processor with associated memory. Memory comprises control algorithms, and can include, but is not limited to, random access memory (RAM), read only memory (ROM), flash memory, and other memory such as a hard disk, floppy disk, and/or other appropriate type of memory. Communications node 102 can initiate and perform communications with remote communication nodes 104, user configuration devices 116, and the like, shown in FIG. 1 in accordance with suitable computer programs, such as control algorithms stored in memory. Servers in communications node 102, while illustrated as coupled to communications node 102, could be implemented at any hierarchical level(s) within distributed communications system 100. For example, route servers 140 could also be implemented within other communication nodes, local nodes 106, the Internet 114, and the like.

Traffic servers 142 can contain traffic information including, but not limited to, traffic reports, traffic conditions, speed data, and the like. Route servers 140 can contain information including, but not limited to, digital road map data, route alternatives, route guidance, and the like. Communications node gateway 138 is also coupled to map databases 146, which can comprise distributed map database and traffic databases 148. Map databases 146 contain additional digital roadmap data. Traffic databases 148 can contain traffic information, for example, traffic conditions, road closures, construction, and the like. POI servers 144 can contain information for points of interests such as gasoline stations, restaurants, motels, movie theatres, and the like.

Each of traffic servers 142, route servers 140, and POI servers 144 can send and receive content data from external servers and databases 120 such as local traffic reports, news agencies, and the like, in addition to content data already stored at communications node 102.

Communications node 102 can also comprise any number of other servers 150 and other databases 152. Other servers 150 can include, for example, wireless session servers, content converters, central gateway servers, personal information servers, and the like. Other databases 152 can include, for example, customer databases, broadcaster databases, advertiser databases, user-profile databases, and the like.

Communications node gateway 138 is coupled to remote communications node gateway 136. Remote communications node gateway 136 is coupled to various navigation applications, which can include, without limitation, route guidance application(s) 128, traffic application(s) 130, POI application(s) 132, and the like. Navigation applications 128, 130, 132 are coupled to, and can process data received from internal and external positioning device(s) 134. Internal positioning device(s) 134 are located within remote communications node 104 or vehicle 108 and can include, for example global positioning system (GPS) unit(s), speedometer, compass, gyroscope, altimeter, and the like. Examples of positioning device(s) 134 external to remote communications node 104 are, without limitation, differential GPS, network-assisted GPS, wireless network positioning systems, and the like.

Remote communications node 104 comprises a user interface device 122 comprising various human interface (H/I) elements such as a display, a multi-position controller, one or more control knobs, one or more indicators such as bulbs or light emitting diodes (LEDs), one or more control buttons, one or more speakers, a microphone, and any other H/I elements required by the particular applications to be utilized in conjunction with remote communications node 104. User interface device 122 is coupled to navigation applications 128, 130, 132 and can request and display route guidance data including, navigation route data, digital roadmap data, and the like. The invention is not limited by the user interface device 122 or the (H/I) elements depicted in FIG. 1. As those skilled in the art will appreciate, the user interface device 122 and (H/I) elements outlined above are meant to be representative and to not reflect all possible user interface devices or (H/I) elements that may be employed.

As shown in FIG. 1, remote communications node 104 comprises a computer 124, preferably having a microprocessor and memory, and storage devices 126 that contain and run an operating system and applications to control and communicate with onboard peripherals.

Remote communications node 104 can optionally contain and control one or more digital storage devices 126 to which real-time broadcasts and navigational data can be digitally recorded. The storage devices 126 may be hard drives, flash disks, or other storage media. The same storage devices 126 can also preferably store digital data that is wirelessly transferred to remote communications node 104 in faster than real-time mode.

In FIG. 1, communications node 102 and remote communications node 104, perform distributed, yet coordinated, control functions within distributed communications system 100. Elements in communications node 102 and elements in remote communications node 104 are merely representative, and distributed communications system 100 can comprise many more of these elements within other communications nodes and remote communications nodes.

Software blocks that perform embodiments of the invention are part of computer program modules comprising computer instructions, such control algorithms, that are stored in a computer-readable medium such as memory described above. Computer instructions can instruct processors to perform methods of operating communications node 102 and remote communications node 104. In other embodiments, additional modules could be provided as needed.

The particular elements of the distributed communications system 100, including the elements of the data processing systems, are not limited to those shown and described, and they can take any form that will implement the functions of the invention herein described.

Figure 2:
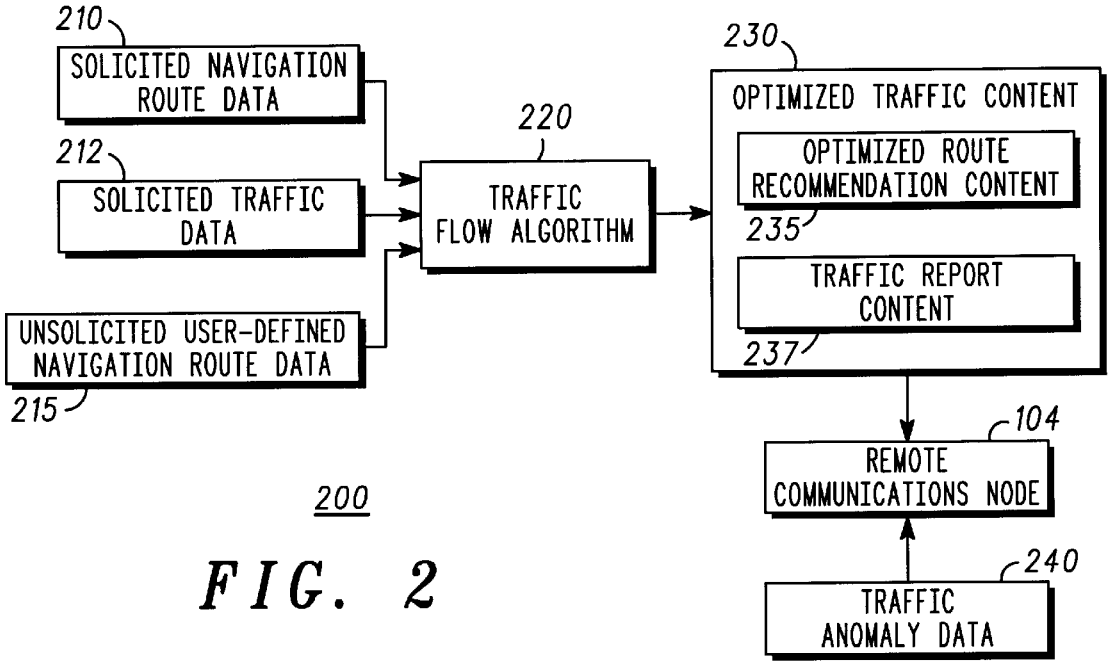
FIG. 2 illustrates a simplified block diagram depicting a method of providing optimized traffic content, according to one embodiment of the invention.

FIG. 2 illustrates a simplified block diagram 200 depicting a method of providing a set of optimized traffic content 230, according to one embodiment of the invention. The block diagram 200 of FIG. 2 can also be used to acquire traffic content and traffic report content as well. As shown in FIG. 2, a set of solicited navigation route data 210, a set of solicited traffic data 212 and a set of unsolicited user-defined navigation route data 215 are input into a traffic flow algorithm 220 in order to output a set of optimized traffic content 230. Set of optimized traffic content 230 can be communicated to remote communications node 104 along with traffic anomaly data 240 pertaining to set of unsolicited user-defined navigation route data 215.

Set of solicited navigation route data 210 can include without limitation data from static digital road map databases, road segments, route segments, and the like. Road segments are elements in the digital road map database that represent road links in the actual road network. Road links are defined as sections of the roadway between intersections. Route segments are road segments that are incorporated into a computed or defined route. Attributes of the individual road segments in the digital road map database include length, posted speed limits, road classification, and the like, which are used to determine optimum routes based on nominal conditions.

Set of solicited traffic data 212 can include without limitation real-time traffic data, floating car data, historical traffic data; and the like. Traffic data can be collected using installed sensors along or in the road, video cameras, accident reports, airborne traffic monitors, and the like. Traffic incidents such as accidents, stalls, construction, delays, and the like, are reported with a location associated with a road segment in the digital map database. Historical traffic data is a compilation of average speeds or travel times for road segments based on any of the above mentioned traffic data sensors. Floating car data is a technique of collection speed and position data from individual vehicles or mobile users with a device that can measure position, speed, and report it to a central location using a wireless communications method. Individual reports from mobile users are compiled to form an aggregate database of real-time traffic flow information. Both set of solicited navigation route data 210 and solicited traffic data 212 are solicited from commercially and publicly available databases and other sources generally available to the public or any contracting entity.

Set of unsolicited user-defined navigation route data 215 can include navigation route data provided directly or indirectly by a user of distributed communications system 100. For example, a user can utilize a user configuration device 116 to input an unsolicited user-defined navigation route (370 in FIG. 3) between two locations utilizing a digital roadmap database, website, and the like. This can comprise a plurality of route segments between two locations that corresponds, for example, with a user's daily commute, or other often traveled route. Set of unsolicited user-defined navigation route data 215 is then communicated to traffic flow algorithm 220 located, for example, in traffic servers 142. As a user travels the unsolicited user-defined navigation route corresponding to the set of unsolicited user-defined navigation route data 215, positioning devices 134 can gather and communicate set of position data, velocity data, time data, and the like, of remote communications node 104 to traffic servers 142. Examples of a set of time data include, but are not limited to total travel time of the route, intermediate travel times of individual route segments, time of day, day of the week, and the like. Examples of a set of velocity data include, but are not limited to average velocity, instantaneous velocity, and the like, which can also be for a given time of day or day of the week. A set of position data, velocity data, time data, and the like collected and/or derived from the data can also be considered set of unsolicited user-defined navigation route data 215, since it corresponds to set of unsolicited user-defined navigation route data 215 input via user interface device 122.

Set of unsolicited user-defined navigation route data 215 differs from set of solicited navigation route data 210 and set of solicited traffic data 212 in that set of solicited navigation route data 210 is pre-programmed or real-time commercially available, standardized data, while set of unsolicited user-defined navigation route data 215 is not pre-programmed, standardized or commercially available to distributed communications system 100 or any its components, but is supplied and received by distributed communications system 100 in a user-initiated, user-defined manner. Set of unsolicited user-defined navigation route data 215 must be supplied at the discretion of users of distributed communications system 100. Set of unsolicited user-defined navigation route data 215 is comprised of preferred navigation route data between two locations that reflects the experiences of the user inputting the navigation data.

A user's preferred route based on experience driving in the area may not be the same as the optimum route determined using available set of solicited navigation route data 210 with or without set of solicited traffic data 212. The user's knowledge of optimum routes in a regularly traveled area is in many cases superior to the routes determined using solicited navigation route data 210 because the digital road map does not have attributes that account for wait time at stop lights, congestion levels at various times of the day, or unusual incidents such as special events and the like. The user's knowledge of traffic flow in a regularly traveled area is also in many cases superior to the solicited traffic data 212 because the traffic data collection sensors and methods do not collect data for all road segments in the road network.

As depicted in FIG. 2, set of solicited navigation route data 210, set of solicited traffic data 212 and set of unsolicited user-defined navigation route data 215 are input to a traffic flow algorithm 220 in order to calculate a set of optimized traffic content 230, which comprises optimal traffic content between two locations. Set of optimized traffic content 230 can be comprised of a set of optimized route recommendation content 235 and a set of traffic report content 237.

Set of optimized route recommendation content 235 can include without limitation one or more optimum route recommendations between any two locations, where routes can be optimized for travel time, distance, speed, and the like, and can also be computed to avoid certain road classes, tollbooths, areas, or bridge heights, and the like. Set of traffic report content 237 can include without limitation any traffic content related to a given navigation route between two locations. For example set of traffic report content 237 can comprise without limitation traffic and road conditions weather conditions, accidents, stalls, delays, construction, and the like, on a given route, for any given time of day, day of the week, and the like.

Traffic flow algorithm 220 continuously receives new and updated set of unsolicited user-defined navigation route data 215 as shown in FIG. 2 to in effect "learn" or "continuously learn" and output optimal traffic content 230. As traffic flow algorithm 220 receives new or updated set of unsolicited user-defined navigation route data 215, it can adjust the weighting factors for the available road segments between two locations based on new and updated input data and continuously optimize the resultant computed routes.

Traffic flow algorithm 220 receives at least the inputs depicted in FIG. 2 and applies a weighting strategy to arrive at optimized traffic content between two locations. Traffic flow algorithm 220 can calculate set of optimized traffic content 230 by applying a weighting scheme to each component of data on each of the plurality of road segments between two locations. Examples of components of data on a road segment can be length, travel time based on predicted or actual data, number of lanes, construction, stop signs, cross traffic, weather, real-time traffic data, and the like. By applying a weight to each of these components for each road segment based on the relative importance of the component or the relative accuracy of the data, a set of optimized traffic content 230 can be calculated. By continually incorporating set of unsolicited user-defined navigation route data 215 into traffic flow algorithm 220, the database of components of data available for the plurality of road segments of a given roadway network are expanded and the accuracy of set of optimized traffic content 230 improved.

The traffic flow algorithm 220 can correlate origins and destination pairs from different users that are in a similar area. Although the routes will not be exactly the same due to the slightly different origins and destinations, the main portion of the route may in fact use the same routing. In such a case, the traffic flow algorithm 220 would assign a weight to the individual route segments that make tip the route in common so that they are favored over other road segments that would otherwise be considered for a route between the origins and destinations based solely on the solicited navigation route data 210 with or without the solicited traffic data 212.

Figure 3:
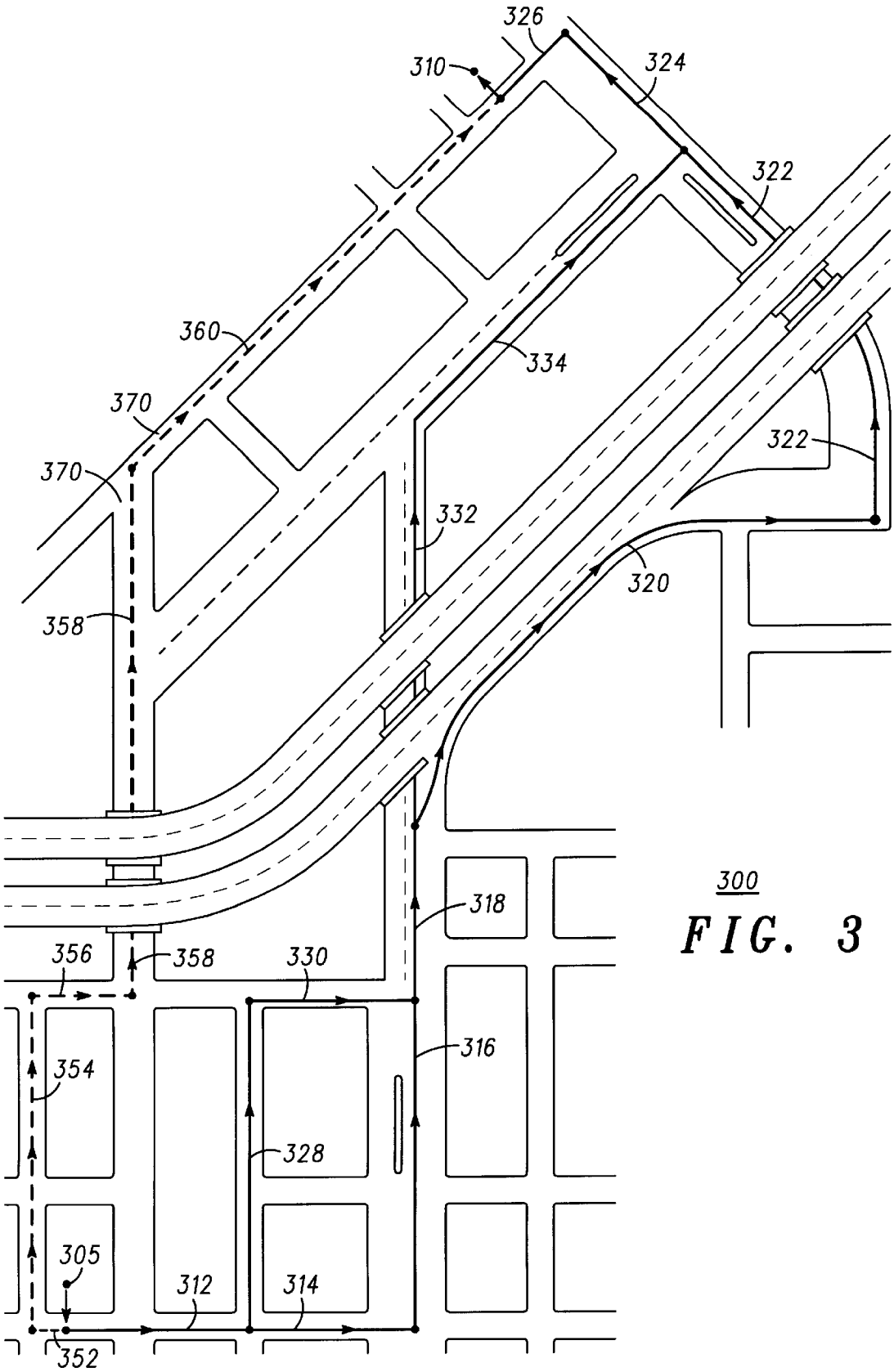
FIG. 3 depicts a simplified roadway network illustrating an exemplary embodiment of the invention.

FIG. 3 depicts a simplified roadway network 300 illustrating an exemplary embodiment of the invention. As depicted in FIG. 3, roadway network 300 is shown with an exemplary starting location 305 and destination location 310 that can be, for example, a starting location and a destination location for remote communications node 104. In this example, a user can log into communications node 102 via user configuration device 116 and input starting location 305 and destination location 310. Based on set of solicited navigation route data 210, solicited traffic data 212 and any set of unsolicited user-defined navigation route data 215 already available for routes between starting location 305 and destination location 310, traffic flow algorithm 220 computes optimized traffic content 230 comprising one or more navigation routes from starting location 305 to destination location 310 based on the user's preferences, for example, minimum travel time, and the like. The plurality of route segments depicted by solid lines with arrows represents exemplary set of optimized traffic content 330, specifically, set of optimized route recommendation content 235 made available to a user. One route includes plurality of route segments (from starting location 305 to destination location 310) 312, 314, 316, 318, 320, 322, 324 and 326. Another route includes plurality of route segments (from starting location 305 to destination location 310) 312, 328, 330, 318, 320, 322, 324 and 326.

In the example presented in FIG. 3, set of unsolicited user-defined navigation route data 315 can comprise a user-defined route from starting location 305 to destination location 310 (as depicted by the plurality of route segments represented as dashed lines). For example, a user can input a route, which has been found by the user to be more optimal than the ones supplied by traffic flow algorithm 220. The route input by the user can include the time of day and/or the days of week that the route is typically used. In this example, set of unsolicited user-defined navigation route data 215 comprises a plurality of route segments, which include route segments 352, 354, 356, 358 and 360. As a user utilizes the unsolicited user-defined navigation route 370 corresponding to the set of unsolicited user-defined navigation route data 215, positioning devices 134 will monitor distances, travel times, and the like, of each of the plurality of route segments of the corresponding unsolicited user-defined navigation route 370 and communicate such data to traffic flow algorithm 220 to incorporate into its weighting scheme. The time of day, day of the week, and the like can also be included in calculating set of optimized traffic content 230. One example is that actual travel times received from remote communications node 104 can override predicted travel times recorded in set of solicited navigation route data 210 and set of solicited traffic data 212 and therefore traffic flow algorithm 220 can utilize the actual route segment travel times and calculate an increasingly optimal set of optimized traffic content 230. Note that the actual and predicted travel times for road segments typically vary during the course of a day or a week, so the times are stored in a table correlating to the various times of day and week.

Figure 4:
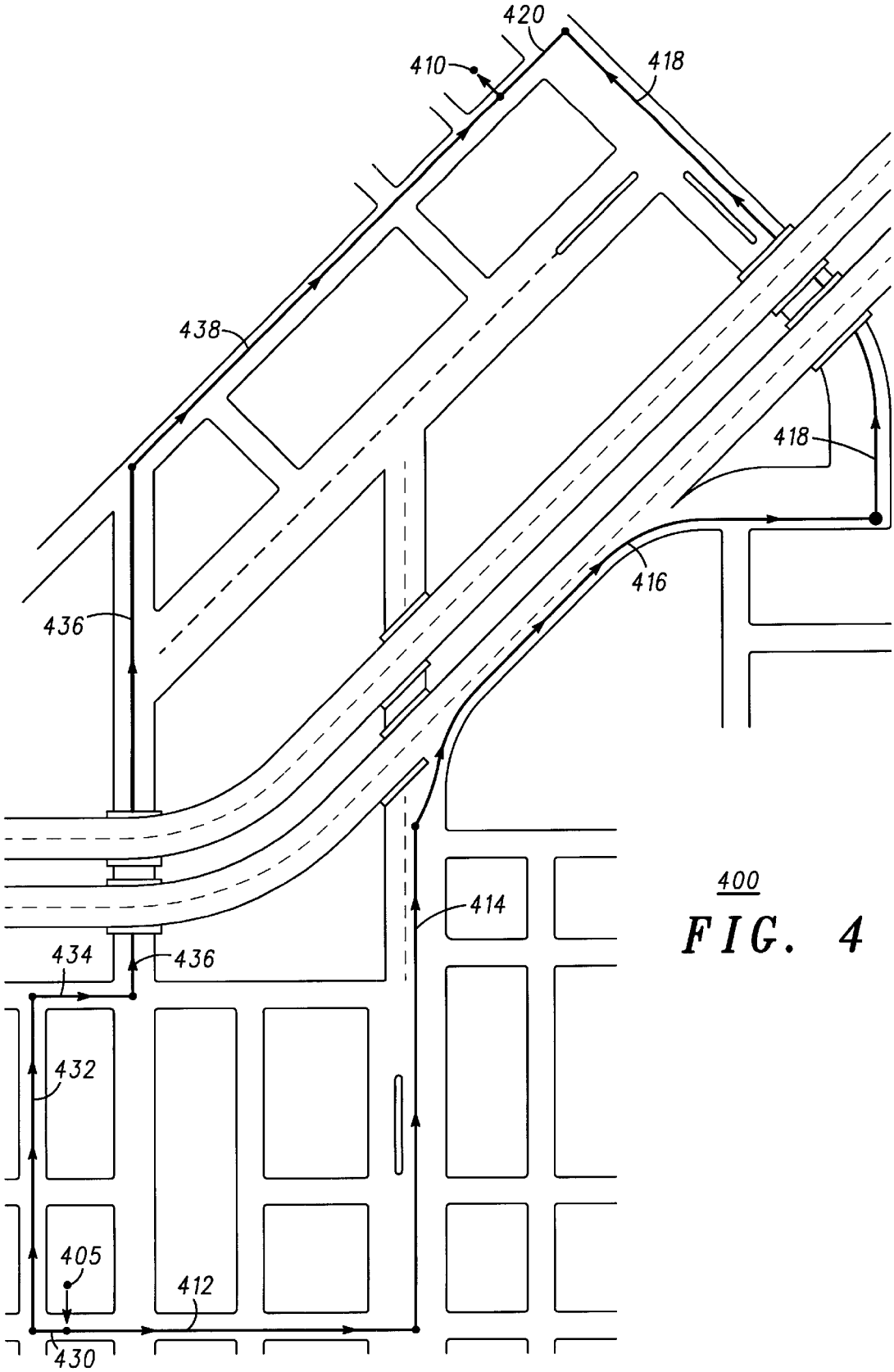
FIG. 4 depicts a simplified roadway network illustrating an exemplary embodiment of the invention.

FIG. 4 depicts a simplified roadway network 400 illustrating an exemplary embodiment of the invention. As shown in FIG. 4, the same roadway network 400, starting location 405 and destination location 410 are depicted as in FIG. 3. However, FIG. 4 represents set of optimized traffic content 230 for starting location 405 and destination location 410 at a later time after the set of unsolicited user-defined navigation route data 215 of FIG. 3 is incorporated into traffic flow algorithm 220. FIG. 4 depicts what the same or a different user who selects substantially the same starting location 405 and destination location 410 can expect traffic flow algorithm 220 to provide after incorporating the set of unsolicited user-defined navigation route data 215 supplied by previously by the same or other user(s). Set of optimized traffic content 230 can be calculated using both set of solicited navigation route data 210, set of solicited traffic data 212 and set of unsolicited user-defined navigation route data 215 or just set of unsolicited user-defined navigation route data 215 depending on the availability of set of solicited navigation route data 210 and set of solicited traffic data 212 for the starting location 305, 405 and destination location 310, 410 specified. In the example shown, traffic flow algorithm 220 has "learned" utilizing set of unsolicited user-defined navigation route data 215 previously supplied to provide a new set of optimized traffic content 230. As shown in FIG. 4, one route includes plurality of route segments (from starting location 405 to destination location 410) 412, 414, 416, 418 and 420. This route is one of the two provided previously by traffic flow algorithm 220 in FIG. 3. Another route includes plurality of route segments (from starting location 405 to destination location 410) 430, 432, 434, 436 and 438. This unsolicited user-defined navigation route 370 is the one previously supplied via set of unsolicited user-defined navigation route data 215.

Once set of unsolicited user-defined navigation route data 215 is input and communicated to traffic flow algorithm 220, set of optimized traffic content 230 can then be communicated to remote communications node 104 to be used for route guidance, and the like. Set of optimized traffic content 230 can include one or more unsolicited user-defined navigation routes 370 corresponding to set of unsolicited user-defined navigation route data 215 and/or one or more routes corresponding to set of solicited navigation route data 210 and set of solicited traffic data 212.

Traffic servers 142 can continuously monitor one or more unsolicited user-defined navigation routes 370 defined by set of unsolicited user-defined navigation route data 215 and communicate as set of traffic anomaly data 240 pertaining to those routes to remote communications node 104. Set of traffic anomaly data 240 can comprise real-time traffic data related to above route(s) and include, without limitation, traffic reports, construction, accidents, unusually high travel times, and the like. Traffic flow algorithm 220 can factor set of traffic anomaly data 240 into route recommendations and suggest alternative routes as necessary.

The invention is not limited by the starting locations, destination location, number of routes or plurality of route segments shown. Any route segment depicted in FIGS. 3 and 4 can be further broken down into any number of smaller route segments. Any number of routes between a starting location and destination location can be utilized or shown, and any number of starting locations and destination locations can be input and utilized.

The method of the invention offers the advantage of allowing traffic flow algorithm 220 to take advantage of user knowledge of a road network, road conditions, traffic conditions, and other tangible and intangible factors not included in commercial databases and other set of solicited navigation route data 210 and set of solicited traffic data 212. This has the advantage of allowing traffic flow algorithm 220 to calculate an increasingly optimal set of optimized traffic content 230 for use by existing and subsequent users of the roadway network and allowing users to save additional time and cost in reaching their destinations.

Figure 5:
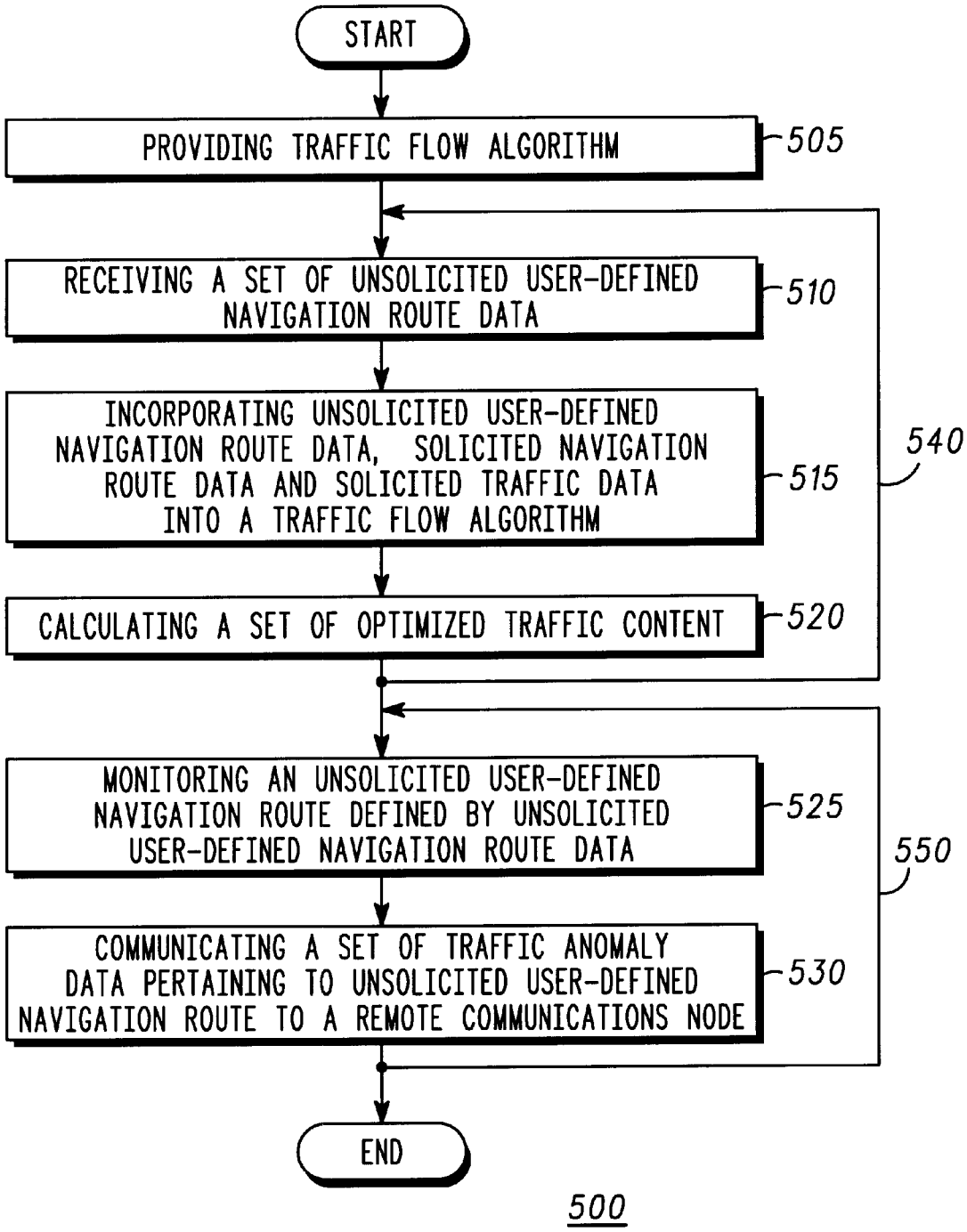
FIG. 5 shows a flow chart of a method of optimizing traffic content, according to one embodiment of the invention.

FIG. 5 shows a flow chart 500 of a method of optimizing traffic content, according to one embodiment of the invention. The method depicted in FIG. 5 can also be used to acquire traffic content as well. In step 505, a traffic flow algorithm 220 is provided and coupled to receive a set of solicited navigation route data 210 and a set of traffic data 212 between a starting location 305, 405 and a destination location 310, 410. Traffic flow algorithm 220 is designed to compute a set of optimized traffic content 230 between starting location 305, 405 and destination location 310, 410.

In step 510, a set of unsolicited user-defined navigation route data 215 is received between starting location 305, 405 and destination location 310, 410. A set of unsolicited user-defined navigation route data 215 can be input via user configuration device 116 and communicated to traffic servers 142, route servers 140, and the like at communications node 102.

In step 515, set of solicited navigation route data 210, set of solicited traffic data 212 and set of unsolicited user-defined navigation route data 215 are incorporated into traffic flow algorithm 220 such that traffic flow algorithm 220 can utilize set of solicited navigation route data 210, set of solicited traffic data 212 and set of unsolicited user-defined navigation route data 215 between starting location 305, 405 and destination location 310, 410.

In step 520, a set of optimized traffic content 230 is calculated between starting location 305, 405 and destination location 310, 410 utilizing at least the set of unsolicited user-defined navigation route data 215. Calculating set of optimized traffic content 230 is an iterative process where traffic flow algorithm 220 "learns" through additional input of set of unsolicited user-defined navigation route data 215 as represented by the return loop arrow 540.

In step 525, one or more unsolicited user-defined navigation routes 370 defined by set of unsolicited user-defined navigation route data 215 are monitored for a set of traffic anomaly data 240 pertaining to one or more unsolicited user-defined navigation routes 370. In step 530, set of traffic anomaly data 240 is communicated to remote communications node 104. The steps of monitoring for and communicating set of traffic anomaly data 240 is repeated as represented by the return loop arrow 550.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A method of optimizing traffic content in a distributed communications system, the method comprising:

providing a traffic flow algorithm coupled to receive a set of solicited navigation route data and a set of solicited traffic data between a starting location and a destination location, wherein the traffic flow algorithm is designed to compute a set of optimized traffic content between the starting location and the destination location;

receiving a set of unsolicited user-defined navigation route data between the starting location and the destination location;

incorporating the set of unsolicited user-defined navigation route data into the traffic flow algorithm; and calculating the set of optimized traffic content between the starting location and the destination location, utilizing at least the set of unsolicited user-defined navigation route data.

2. The method of claim 1, wherein the set of unsolicited user-defined navigation route data comprises a plurality of route segments between the starting location and the destination location.

3. The method of claim 2, wherein the set of unsolicited user-defined navigation route data comprises a set of time data for a remote communications node along one or more of the plurality of route segments between the starting location and the destination location.

4. The method of claim 2, wherein the set of unsolicited user-defined navigation route data comprises a set of velocity data of a remote communications node along one or more of the plurality of route segments between the starting location and the destination location.

5. The method of claim 2, wherein the set of unsolicited user-defined navigation route data comprises a set of position data of a remote communications node along one or more of the plurality of route segments between the starting location and the destination location.

6. The method of claim 1, further comprising monitoring an unsolicited user-defined navigation route defined by the set of unsolicited user-defined navigation route data and communicating a set of traffic anomaly data pertaining to the unsolicited user-defined navigation route to a remote communications node.

7. The method of claim 1, wherein the set of optimized traffic content comprises a set of optimized route recommendation content.

8. The method of claim 1, wherein the set of optimized traffic content comprises a set of traffic report content pertaining to an unsolicited user-defined navigation route defined by the set of unsolicited user-defined navigation route data.

9. A method of acquiring traffic content in a distributed communications system, the method comprising:

providing a traffic flow algorithm coupled to receive a set of solicited navigation route data and a set of solicited traffic data between a starting location and a destination location, wherein the traffic flow algorithm is designed to compute a set of optimized traffic content between the starting location and the destination location;

receiving a set of unsolicited user-defined navigation route data between the starting location and the destination location; and incorporating the set of unsolicited user-defined navigation route data into the traffic flow algorithm.

10. The method of claim 9, wherein the set of unsolicited user-defined navigation route data comprises a plurality of route segments between the starting location and the destination location.

11. The method of claim 10, wherein the set of unsolicited user-defined navigation route data comprises a set of time data for a remote communications node along one or more of the plurality of route segments between the starting location and the destination location.

12. The method of claim 10, wherein the set of unsolicited user-defined navigation route data comprises a set of velocity data of a remote communications node along one or more of the plurality of route segments between the starting location and the destination location.

13. The method of claim 10, wherein the set of unsolicited user-defined navigation route data comprises a set of position data of a remote communications node along one or more of the plurality of route segments between the starting location and the destination location.

14. The method of claim 9, further comprising monitoring an unsolicited user-defined navigation route defined by the set of unsolicited user-defined navigation route data and communicating a set of traffic anomaly data pertaining to the unsolicited user-defined navigation route to a remote communications node.

15. The method of claim 9, further comprising calculating a set of optimized traffic content between the starting location and the destination location, utilizing at least the set of unsolicited user-defined navigation route data.

16. A computer-readable medium containing computer instructions for instructing a processor to perform a method of acquiring traffic content in a distributed communications system, the instructions comprising:

providing a traffic flow algorithm coupled to receive a set of solicited navigation route data and a set of solicited traffic data between a starting location and a destination location, wherein the traffic flow algorithm is designed to compute a set of optimized traffic content between the starting location and the destination location;

receiving a set of unsolicited user-defined navigation route data between the starting location and the destination location; and incorporating the set of unsolicited user-defined navigation route data into the traffic flow algorithm.

17. The computer-readable medium in claim 16, wherein the set of unsolicited user-defined navigation route data comprises a plurality of route segments between the starting location and the destination location.

18. The computer-readable medium in claim 17, wherein the set of unsolicited user-defined navigation route data comprises a travel time for a remote communications node along one or more of the plurality of route segments between the starting location and the destination location.

19. The computer-readable medium in claim 17, wherein the set of unsolicited user-defined navigation route data comprises an average velocity of a remote communications node along one or more of the plurality of route segments between the starting location and the destination location.

20. The computer-readable medium in claim 17, wherein the set of unsolicited user-defined navigation route data comprises an instantaneous velocity of a remote communications node along one or more of the plurality of route segments between the starting location and the destination location.

21. The computer-readable medium in claim 16, instructions further comprising monitoring an unsolicited user-defined navigation route defined by the set of unsolicited user-defined navigation route data and communicating a set of traffic anomaly data pertaining to the unsolicited user-defined navigation route to a remote communications node.

22. The computer-readable medium in claim 16, the instructions further comprising calculating a set of optimized traffic content between the starting location and the destination location, utilizing at least the set of unsolicited user-defined navigation route data.

* * * * *